US008672174B1

(12) United States Patent
McMullin

(10) Patent No.: US 8,672,174 B1
(45) Date of Patent: Mar. 18, 2014

(54) MULTI-FUNCTION LID FOR BEVERAGE CONTAINERS

(71) Applicant: Leedsworld, Inc., New Kensington, PA (US)

(72) Inventor: Morgan Requel McMullin, Pittsburgh, PA (US)

(73) Assignee: Leedsworld, Inc., New Kensington, PA (US)

( * ) Notice: Subject to any disclaimer, the term of this patent is extended or adjusted under 35 U.S.C. 154(b) by 0 days.

(21) Appl. No.: 13/739,409

(22) Filed: Jan. 11, 2013

(51) Int. Cl.
*A47G 21/18* (2006.01)
*A47G 19/22* (2006.01)
*B65D 77/28* (2006.01)

(52) U.S. Cl.
CPC ..... *A47G 21/18* (2013.01); *A47G 19/22* (2013.01); *B65D 77/286* (2013.01); *B65D 77/28* (2013.01)
USPC ..... 220/703; 220/705; 220/707; 220/708; 220/709; 220/713; 220/819; 220/826; 220/254.2; 220/254.3; 222/526; 222/533; 222/534; 222/535; 215/229; 215/388; 239/24; 239/33; 239/32

(58) Field of Classification Search
USPC ..... 220/254.2, 826, 428, 819, 709, 254.3, 220/254, 714, 705, 708, 713; 222/526–529, 222/533–535, 484; 215/229, 388; 239/33, 239/24, 32; D9/443
See application file for complete search history.

(56) References Cited

U.S. PATENT DOCUMENTS 1,962,883 A * 6/1934 Tate et al. ..... 215/11.1
2,609,985 A * 9/1952 Reid et al. ..... 229/125.05
2,844,267 A * 7/1958 Petriccione ..... 215/388
2,936,934 A * 5/1960 Kubiliunas ..... 222/484
2,979,238 A * 4/1961 Bramming ..... 222/484
3,240,415 A * 3/1966 Pugh ..... 229/103.1
3,362,607 A * 1/1968 Weitzner ..... 229/103.1
4,485,963 A * 12/1984 Panicci ..... 229/103.1
4,732,303 A * 3/1988 Wang ..... 222/484
4,903,870 A * 2/1990 La Vange ..... 222/482
5,065,909 A * 11/1991 Pino et al. ..... 222/484
5,150,815 A * 9/1992 Saklad ..... 220/708
5,188,283 A * 2/1993 Gu ..... 229/103.1
5,203,468 A * 4/1993 Hsu ..... 220/254.3
5,203,841 A * 4/1993 Kitabayashi ..... 222/402.11
5,242,079 A * 9/1993 Stephens et al. ..... 220/705
5,244,113 A * 9/1993 Stymiest ..... 220/710.5
5,273,172 A * 12/1993 Rossbach et al. ..... 215/229
5,339,982 A * 8/1994 Tardie ..... 220/708
5,361,934 A * 11/1994 Spence, Jr. ..... 220/707
5,370,279 A * 12/1994 Tardif ..... 222/214
D354,198 S * 1/1995 Chiang et al. ..... D7/510

(Continued)

*Primary Examiner* — Mickey Yu
*Assistant Examiner* — Gideon Weinerth
(74) *Attorney, Agent, or Firm* — Buchanan Ingersoll & Rooney PC

(57) ABSTRACT

A lid assembly including a cover member for attachment to a container, the cover including first and second apertures providing access to contents of the container; a drinking member having a bore there through, the drinking member pivotal between a first closed position wherein the drinking member seals the first aperture and a second open position wherein the bore is aligned with the first aperture to allow contents of the container to pass through the first aperture and the drinking member; and a closure member pivotal between a first closed position wherein the closure member seals the second aperture and a second open position wherein the second aperture is exposed to allow contents of the container to pass there through.

20 Claims, 6 Drawing Sheets

(56) References Cited

U.S. PATENT DOCUMENTS

| | | | | |
|---|---|---|---|---|
| 5,415,312 | A * | 5/1995 | Mueller | 220/254.3 |
| 5,477,994 | A | 12/1995 | Feer et al. | |
| 5,582,315 | A * | 12/1996 | Reid | 220/254.4 |
| 5,615,809 | A | 4/1997 | Feer et al. | |
| 5,687,872 | A * | 11/1997 | Nmngani | 220/710 |
| 5,897,013 | A * | 4/1999 | Manganiello | 220/252 |
| 5,908,126 | A * | 6/1999 | Wang | 215/229 |
| 5,961,010 | A * | 10/1999 | Smith | 222/534 |
| 6,050,433 | A * | 4/2000 | Russell et al. | 215/229 |
| 6,053,374 | A * | 4/2000 | Santagiuliana | 222/534 |
| 6,237,817 | B1 * | 5/2001 | Son | 222/527 |
| 6,382,476 | B1 * | 5/2002 | Randall et al. | 222/545 |
| 6,494,332 | B1 * | 12/2002 | Haughton et al. | 215/355 |
| 6,595,822 | B1 * | 7/2003 | Thai | 446/16 |
| 6,609,624 | B2 * | 8/2003 | Goto et al. | 220/259.1 |
| 6,783,019 | B2 | 8/2004 | Zettle et al. | |
| 7,059,490 | B2 | 6/2006 | Son | |
| 7,255,241 | B2 | 8/2007 | Yoneoka et al. | |
| D564,830 | S * | 3/2008 | Holmes | D7/392 |
| 7,392,916 | B1 * | 7/2008 | Kuighadush | 220/707 |
| 7,516,862 | B2 * | 4/2009 | McDonough | 215/229 |
| 7,533,783 | B2 * | 5/2009 | Choi et al. | 220/714 |
| 7,594,587 | B2 * | 9/2009 | Auer | 220/326 |
| 7,690,524 | B2 * | 4/2010 | Chau | 220/254.3 |
| 7,931,166 | B2 | 4/2011 | Cuocolo, Jr. | |
| 8,336,724 | B2 * | 12/2012 | Yamashita et al. | 220/254.1 |
| 8,376,173 | B2 * | 2/2013 | Britto et al. | 220/254.3 |
| 2002/0158069 | A1 | 10/2002 | Yoneoka et al. | |
| 2002/0179604 | A1 * | 12/2002 | Germain et al. | 220/254.2 |
| 2003/0015556 | A1 | 1/2003 | Wild et al. | |
| 2003/0052126 | A1 | 3/2003 | Zettle et al. | |
| 2003/0168455 | A1 | 9/2003 | Zettle et al. | |
| 2009/0090748 | A1 | 4/2009 | Harrison | |
| 2012/0305559 | A1 * | 12/2012 | Steininger | 220/253 |

* cited by examiner

MULTI-FUNCTION LID FOR BEVERAGE CONTAINERS

FIELD OF THE INVENTION

The present disclosure is generally directed towards beverage containers and beverage container lids and, more particularly, toward beverage container lids having multi-functionality integral with the lid enabling beverages to be consumed either by sipping or through a straw. The present disclosure has particular utility in the consumption of hot and cold beverages.

BACKGROUND OF THE INVENTION

Beverage containers and lids therefore are commonly sold and are used for the containment and consumption of beverages such as juice, soft drinks, water, coffee tea, etc. Typically, beverage containers will include a lid which covers a top opening through which the container is filled. The lids may be screwed onto the container, snap fit, friction fit, or otherwise removably attached. The lid is designed to prevent the beverage from spilling while still allowing the beverage to be consumed.

For instance, the lid may have a slot or opening therein that allows the beverage to be sipped or otherwise consumed from the container. Such lids are often used for hot beverages, such as, for example, coffee, tea, etc., as it is often preferred to sip a hot beverage so that the temperature of the beverage may be determined before a large amount is consumed. Alternately, the lid may have a piercing portion, or other opening, into which a straw may be inserted. The lid may also include a spout though which the beverage may be sucked or squeezed from the container, e.g., a child's sippy cup or a sport water bottle. Consumption of a beverage through a straw or spout is not typically preferred for hot beverages but, rather, is used for cold beverages, such as, for example, juice, water, soft drinks, etc.

Prior art lids typically have either an opening for sipping the beverage from the container or an opening for consuming the beverage from a straw, but not both. Even if a lid does have both, one of the openings is typically open at any one time. In this event, the advantage of using a lid to prevent spillage is lost.

In the advent of the "green" era, plastic lids and containers which may be reused are becoming more and more prevalent. If a user wishes to consume beverages through sipping, such as a hot beverage, one type of lid having an appropriate opening will typically need to be used. Conversely, if a user wishes to drink a beverage through a straw, such as a cold beverage, a different type of lid having a different type of opening will typically need to be used. This requires a person to carry different lids, which is often an inconvenience. Additionally, unless the lid can be fully closed, the possibility of spillage is present.

The present disclosure is directed toward overcoming one or more of the above-identified problems.

SUMMARY OF THE INVENTION

A lid assembly for containers is disclosed herein. The lid assembly includes a cover member for attachment to the container, the cover member including first and second apertures providing access to the contents (i.e., beverage) of the container; a drinking member having a bore therethrough, the drinking member pivotal between a first closed position wherein the drinking member seals the first aperture and a second open position wherein the bore is aligned with the first aperture to allow the contents of the container to pass through the first aperture and the drinking member; and a closure member pivotal between a first closed position wherein the closure member seals the second aperture and a second open position wherein the second aperture is exposed to allow contents of the container to pass there through. The drinking member acts as a straw to allow a person to consume the beverage through the first aperture by sucking. This has particular utility for cold beverages. A person may sip or otherwise consume the beverage through the second opening. This has particular utility for hot beverages.

In one form, the cover member is removably attached to the container via screw fit, snap fit or friction fit. Of course, other attachment means can be utilized. The cover member may be configured to be used with various containers. The cover member, the drinking member and the closure member can be made of plastic or other polymer materials. Again, other materials are contemplated.

The cover member may include a vent aperture, wherein with the closure member in the first closed position the closure member seals the vent aperture, and with the closure member in the second open position the vent aperture is exposed to allow air to be vented from the container. In one form, the closure member includes a protrusion extending from one side thereof, the protrusion shaped to engage the second aperture with the closure member in the first closed position. Similarly, the closure member includes a vent protrusion extending from the one side thereof, the vent protrusion shaped to engage the vent aperture with the closure member in the first closed position. Thus, with the closure member in the first closed position, both the second aperture and the vent aperture are sealed.

In another form, the cover member includes a straw member extending therefrom and in fluid communication with the first aperture, the straw member extending into the container with the cover member attached to the container. Thus, with the bore in the drinking member aligned with the first aperture, the beverage may be consumed as if through a straw formed by the drinking member, the first aperture and the straw member. The straw member may be permanently attached or removably attached to the cover member.

In a further form, the drinking member and the closure member have the same axis of rotation. To reduce the overall profile of the lid assembly, with the drinking member and the closure member each in the first closed position, the first and second apertures are sealed and the drinking member and the closure member lie adjacent one another. Additionally, the drinking member and the closure member may be disposed in a channel formed in a top surface of the cover member, such that the top surface of the cover member is substantially flat with the drinking and closure members are in their first closed positions.

In one form, the drinking member is pivotal to a third closed position wherein the drinking member seals the first aperture. The first closed position and the second open position of the drinking member are approximately 90-degrees apart, while the third closed position and the first closed position of the drinking member are greater than 90-degrees apart. Additionally, the first closed position and the second open position of the closure member are greater than 90-degrees apart. However, these angles are exemplary only and other angular displacements may be utilized.

In another form, with the drinking member in the third closed position the closure member is pivotal from the first closed position to the second open position. Further, the lid assembly may be configured such that the closure member is only pivotal from the first closed position to the second open position with the drinking member in the third closed position. This helps ensure that the first aperture is closed before the second aperture is exposed.

In yet another form, the drinking member is only pivotal to the third closed position by pivoting the closure member from the first closed position.

In still another form, the drinking member has at least one pin that engages at least one stop surface on the closure member as the drinking member is moved from the second open position to the third closed position to move the closure member from the first closed position.

In a further form, with the drinking member in the third closed position and the closure member in the second open position, the drinking member and the closure member lie adjacent one another.

It is an object of the present disclosure to provide a multi-function lid assembly that permits a beverage to be consumed by sucking through a straw or sipped.

It is a further object of the present disclosure to provide a multi-function lid assembly that allows both hot and cold beverages to be consumed from a container in different manners typically preferred for each.

Various other objects, aspects and advantages of the present disclosure can be obtained from a study of the specification, the drawings, and the appended claims.

BRIEF DESCRIPTION OF THE DRAWINGS

Further possible embodiment(s) are shown in the drawings. The present disclosure is explained in the following in greater detail with reference to exemplary embodiment(s) depicted in drawings. In the drawings.

DETAILED DESCRIPTION OF THE INVENTION

Figure 1:
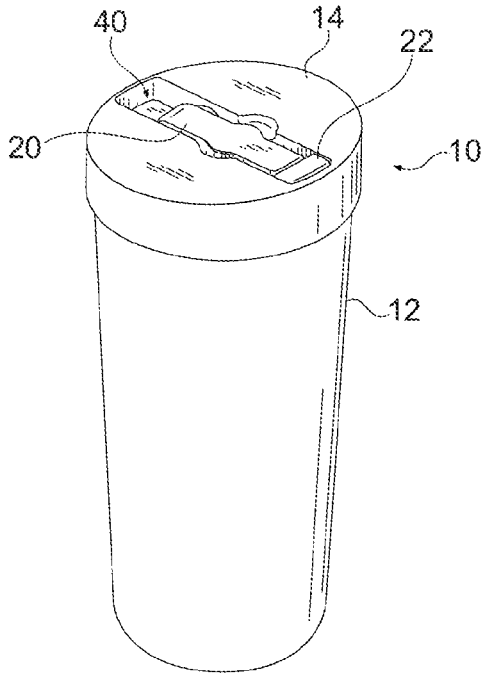
FIG. 1 is a perspective view of the inventive lid assembly attached to a container with both the drinking member and the closure member in first closed positions.

FIGS. 1-7 illustrate the inventive lid assembly, shown generally at 10, attached to a container 12. The container 12 is designed to hold beverages, such as juice, soft drinks, water, coffee, tea and the like. The lid assembly 10 may be attached to the container 12 by any means, such as, for example, screw fit, snap fit, friction fit, etc. In a preferred form, the lid assembly 10 is removably attached to the container 12.

The lid assembly 10 includes a cover member 14 attachable to the container 12 and having first 16 and second 18 apertures formed therein. The lid assembly 10 further includes a drinking member 20 and a closure member 22 pivotally attached to the cover member 14. The drinking member 20 is pivotal to open and close the first aperture 16, while the closure member 22 is pivotal to open and close the second aperture 18. Opening and closing the first 16 and second 18 apertures allows a person to consume the beverage content in the container 12 either by sipping (through the second aperture 18) or by sucking via a straw (through the first aperture 16).

Figure 2:
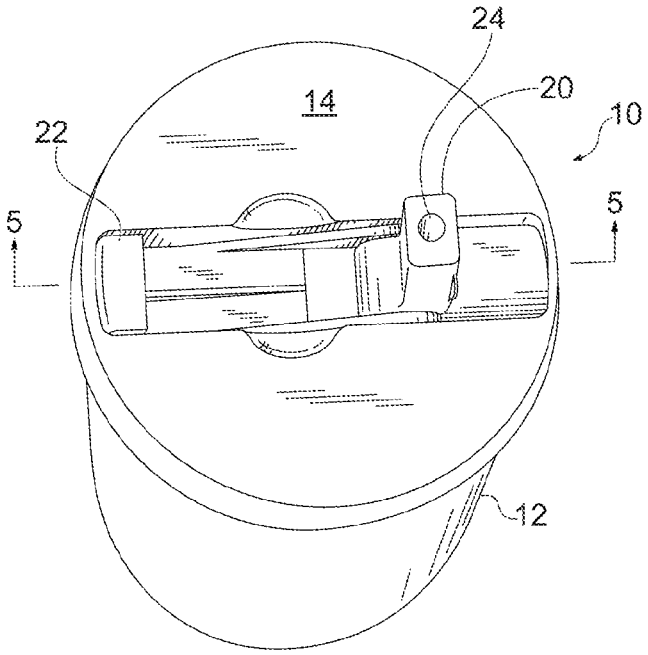
FIG. 2 is a perspective view of the inventive lid assembly attached to a container with the drinking member in the second open position and the closure member in the first closed position.
Figure 3:
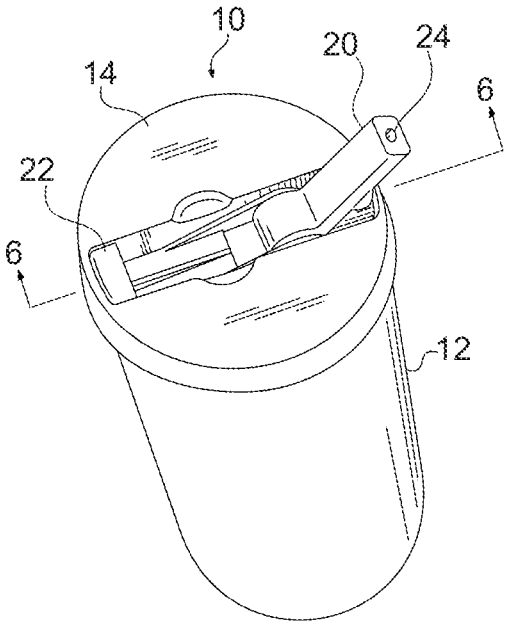
FIG. 3 is a perspective view of the inventive lid assembly attached to a container with the drinking member in the third closed position and the closure member in the first closed position.
Figure 5:
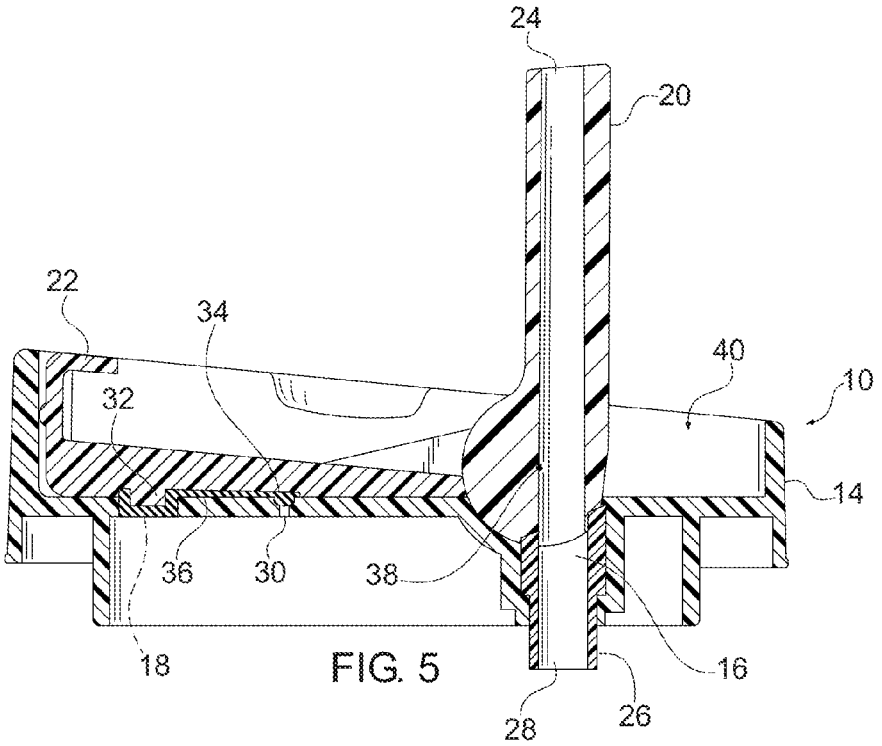
FIG. 5 is a cross-sectional view of the inventive lid assembly taken along line 5-5 in FIG. 2 with the drinking member in the second open position and the closure member in the first closed position.

The drinking member 20 is pivotal between a first closed position (as shown in FIG. 1) and a second open position (as shown in FIGS. 2 and 5). In the first closed position, the drinking member 20 seals the first aperture 16. The drinking member 20 includes a bore 24 extending therethrough which, in the second open position, is aligned with the first aperture 16 such that beverage contents in the container 12 may be sucked therefrom in a straw-like manner. To facilitate consumption of the beverage in this manner, a straw member 26 is attached to the cover member 14 and is in fluid communication with the first aperture 16 (see FIGS. 5-7). The straw member 26 includes an aperture 28 extending therethrough and extends into the container 12 so that the beverage may be sucked out of the container 12 through the straw member 26, the first aperture 16 and the drinking member 20. Consuming a beverage through a straw is often preferred for cold beverages, but is not limited thereto.

While the drinking member 20 is in the second open position, the closure member 22 remains in the first closed position to seal the second aperture 18. In the embodiment described herein, the first closed position and second open position of the drinking member 20 are approximately 90-degrees apart; however, the present disclosure is not limited thereto and other angular displacements are contemplated.

The drinking member 20 is further pivotal to a third closed position (as shown in FIGS. 3-4 and 6-7). In the embodiment show, the third closed position is greater than 90-degrees from the first closed position, and thus a user pivots the drinking member 20 past the second open position to reach the third closed position. However, the present disclosure is not limited thereto and other angular displacements are contemplated.

Figure 4:
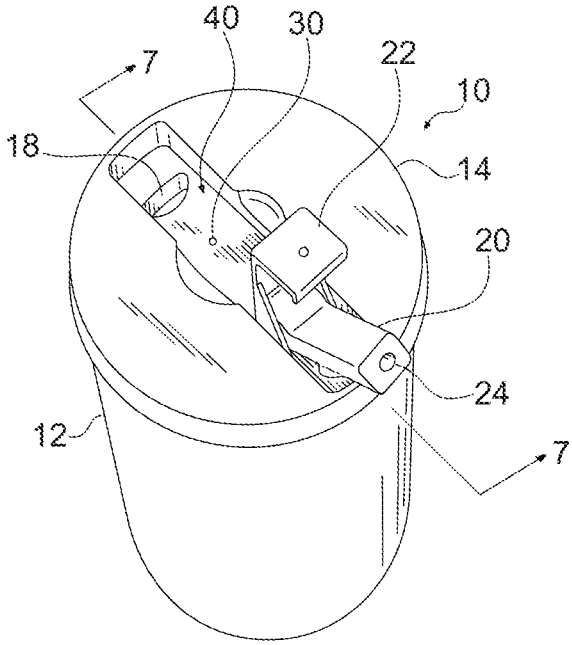
FIG. 4 is a perspective view of the inventive lid assembly attached to a container with the drinking member in the third closed position and the closure member in an open position.

In the third closed position, the drinking member 20 seals the first aperture 16. The closure member 22 may then be pivoted from a first closed position (as shown in FIGS. 1-3 and 5-6) to a second open position (as shown in FIGS. 4 and 7). In the first closed position, the closure member 22 seals the second opening 18. The cover member 14 additionally includes a vent aperture 30, and the closure member 22 also seals the vent aperture 30 in the first closed position. To facilitate the sealing, the closure member has a projection or protrusion 32 and a vent projection or protrusion 34 extending from one side thereof which engages the second aperture 18 and the vent aperture 30, respectively, with the closure member 22 in the first closed position. To further facilitate the sealing, the closure member 22 includes a gasket member 36 which covers the protrusions 32 and 34 and provides a tight sealing of the second 18 and vent 30 apertures. The gasket member 36 may be made of rubber or other material to sufficiently seal the apertures 18 and 30.

Pivoting the closure member 22 to the second open position exposes the second 18 and vent 30 apertures. With the apertures 18 and 30 exposed, a person may sip or otherwise consume a beverage from the container 12 through the second aperture 18 while air is vented from the container 12 through the vent aperture 30 to allow smooth flow of the beverage. Consuming a beverage by sipping is often preferred for hot beverages, but is not limited thereto.

Figure 6:
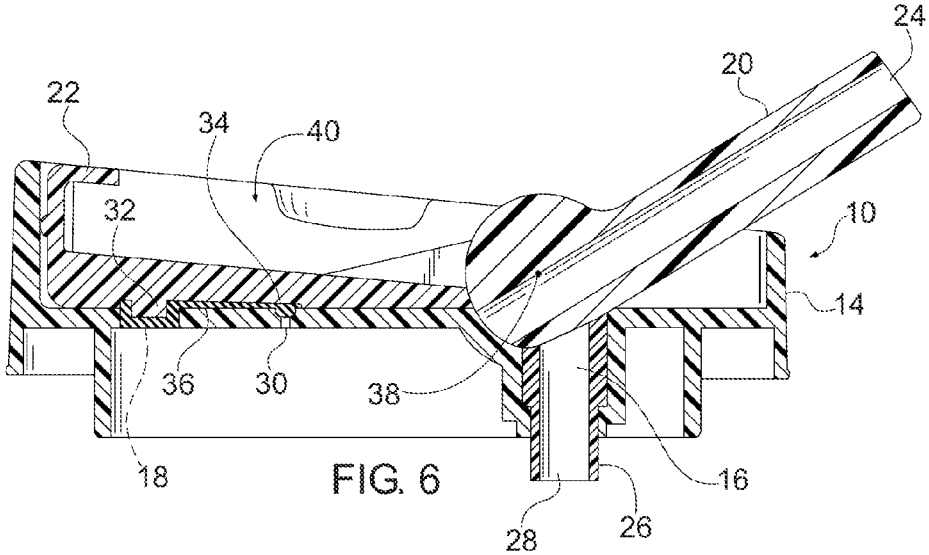
FIG. 6 is a cross-sectional view of the inventive lid assembly taken along line 6-6 in FIG. 3 with the drinking member in the third closed position and the closure member in the first closed position.
Figure 7:
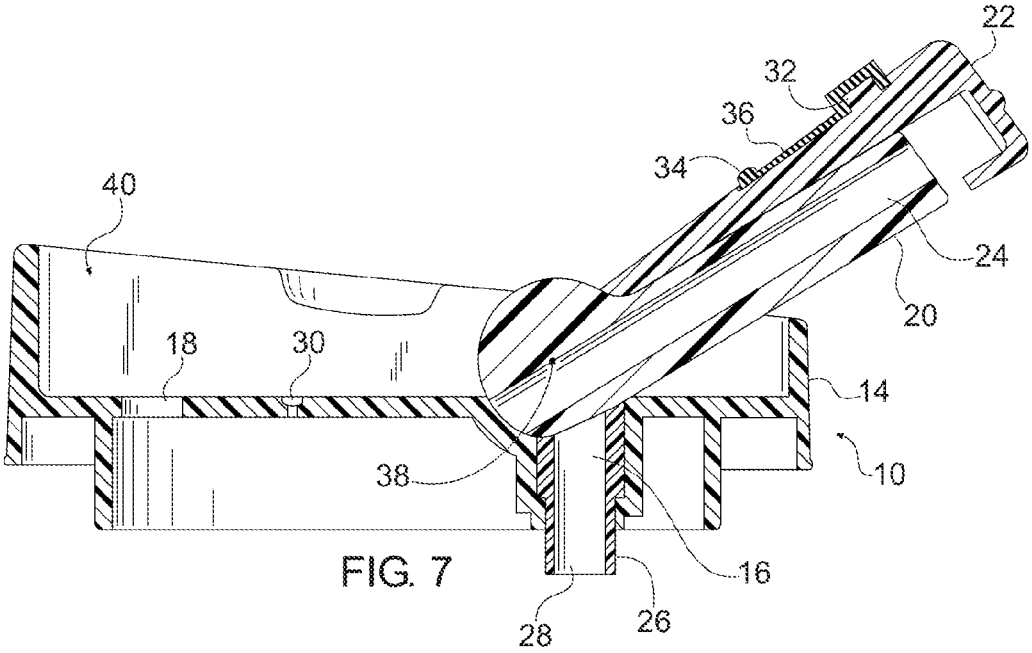
FIG. 7 is a cross-sectional view of the inventive lid assembly taken along line 7-7 in FIG. 4 with drinking member in the third closed position and the closure member in the second open position.

In the embodiment shown, both the drinking member 20 and the closure member 22 are pivotal about the same axis of rotation 38 (see FIGS. 5-7). However, the present disclosure is not limited thereto, and different axes of rotation may be implemented without departing from the spirit and scope of the present disclosure.

As shown in the FIGS. 1-7, the drinking member 20 and the closure member 22 are disposed in a channel 40 formed in a top surface of the cover member 14. This has the advantage that the top surface of the cover member 14 may remain substantially flat when the drinking member 20 and the closure member 22 are both pivoted to their first closed positions (see FIG. 1). When both the drinking member 20 and the closure member 22 are pivoted to their first closed position, the drinking 20 and closure 22 members lie adjacent one another. (See FIG. 1). Similarly, when the drinking member 20 is pivoted to its third closed position and the closure member 22 is pivoted to its second open position, the drinking 20 and closure 22 members lie adjacent one another. (See FIG. 7). The second open position of the closure member 22 may be any position where the second 18 and vent 30 apertures are exposed. For example, FIG. 4 illustrates the closure member 22 in the second open position, even though the closure member 22 is not lying adjacent to the drinking member 20. This is still considered the second open position since the second 18 and vent 30 apertures are exposed allowing a beverage to be sipped or otherwise consumed from the container 12 through the second aperture 18.

The cover member 14, the drinking member 20 and the closure member 22 may have cooperating structure or other mechanisms (not shown) that maintain the drinking member 20 and closure member 22 in their respective closed and open positions. Such structure may include, for example, cooperating detents and projections that create frictional forces sufficient to maintain the drinking 20 and closure 22 members in their respective positions, but also allow them to be pivotal without extensive effort by a user.

Further, structure or other mechanisms (not shown) may be provided to only allow the closure member 22 to pivot from its first closed position to its second open position when the drinking member 20 is in its third closed position. This helps prevent spillage by ensuring that the first aperture 16 is sealed before the second aperture 18 is exposed.

Figure 8:
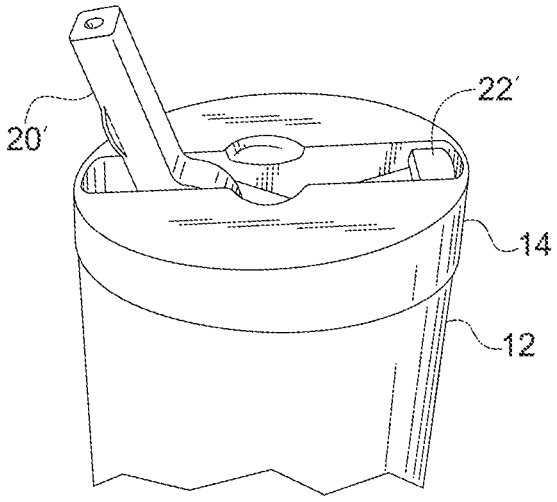
FIG. 8 is a perspective view of an alternate embodiment of the inventive lid assembly attached to a container with the drinking member between the second open and third closed positions and the closure member in the first closed position.
Figure 9:
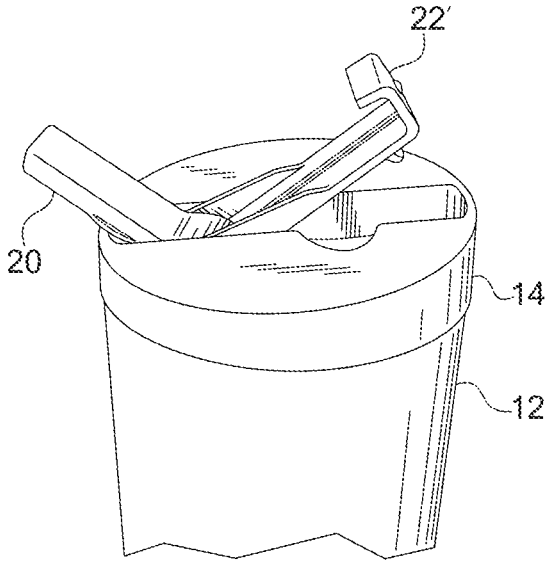
FIG. 9 is a perspective view of the alternate embodiment of the inventive lid assembly attached to a container with the drinking member in the third closed positions and the closure member moved from the first closed position.
Figure 10:
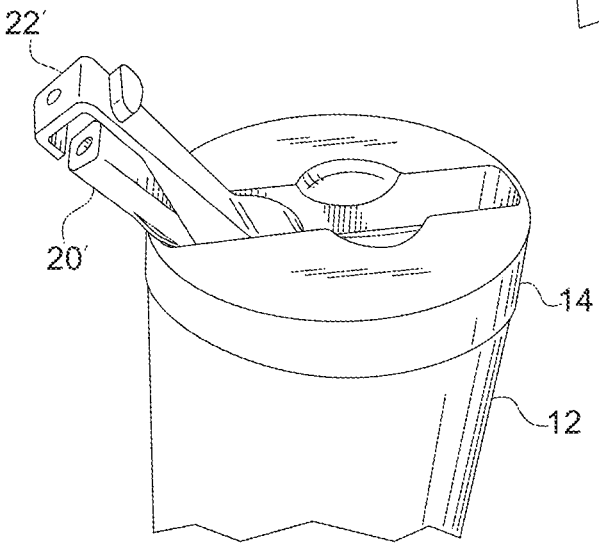
FIG. 10 is a perspective view of the alternate embodiment of the inventive lid assembly attached to a container with the drinking member in the third closed positions in the second open position.

In an alternate embodiment, shown in FIGS. 8-12, similar elements are indicated with the same reference number, while elements that have been modified are indicated with a prime ('). As shown in FIG. 8, the drinking member 20' is movable to a position between the second open position and the third closed position, which represents the maximum angle of the drinking member 20' with the closure member 22' remaining in the first closed position. In order for the drinking member 20' to be moved to the third closed position, the closure member 22' must be moved to an open position, as shown in FIG. 9. Then, the drinking member 20' may be moved to its third closed position and the closure member 22' may be moved to its second open position, as shown in FIG. 10.

Figure 11:
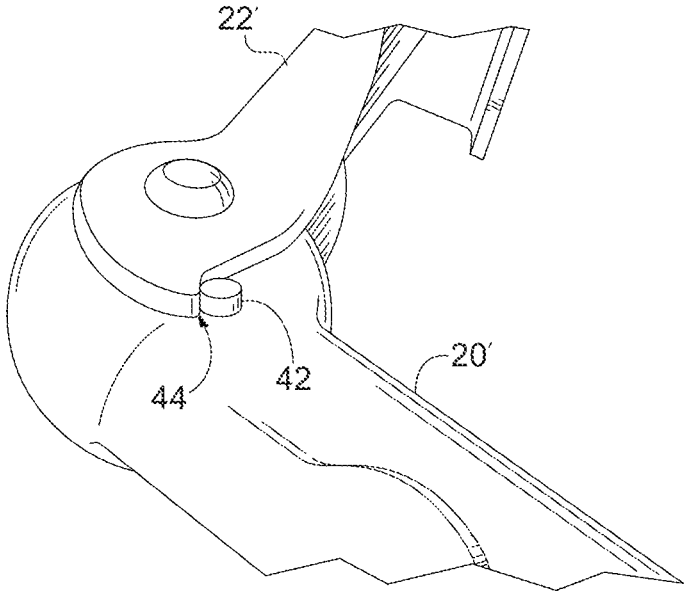
FIGS. 11-12 are perspective views of the drinking member and closure member of the alternate embodiment of the inventive lid assembly.
Figure 12:
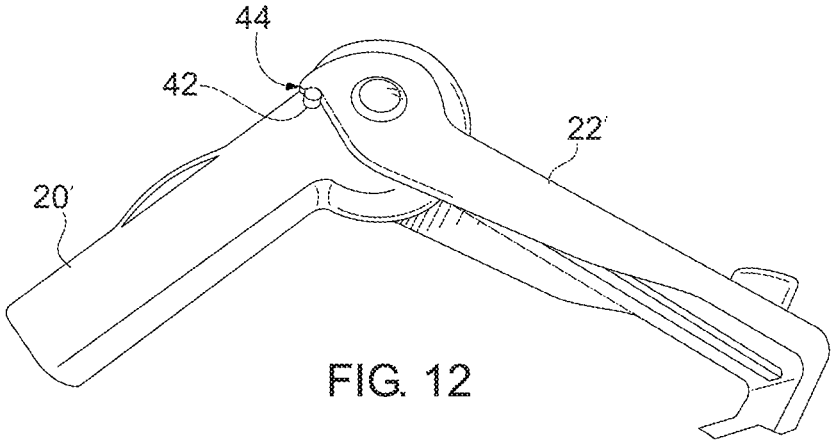

To facilitate such movement of the drinking 20' and closure 22' members, the drinking member 20' has at least one pin 42 that engages a stop surface 44 on the closure member, as shown in FIGS. 11-12. The drinking member 20' and closure member 22' are rotatably attached to the cover member 14 and to each other. The drinking member 20' has a pin 42 that extends outward from a side of the drinking member 20'. As the drinking member 20' is rotated, the pin 42 rotates until it engages the stop surface 44 formed on the closure member 22'. At this point, the drinking member 20' cannot be rotated further until the closure member 22' is rotated open to move the stop surface 44 and allow the drinking member 20' to rotate further. While only one pin 42 and stop surface 44 is show in FIGS. 11-12, the drinking member 20' may have opposing pins 42 which engage corresponding opposing stop surfaces 44 formed on the closure member 22'. Additionally, one skilled in the art will appreciate that the mechanism to facilitate such movement between the drinking 20' and closure 22' members may take any form without departing from the spirit and scope of the present invention.

It is contemplated herein that the cover member 14, the drinking member 20, 20' and the closure member 22, 22' be made of a hard plastic or other polymer material. Such materials are durable and resilient and are well suited for the beverage container industry. However, other materials may be utilized for all or any the components described herein without departing from the spirit and scope of the present disclosure.

It will be apparent to those skilled in the art that numerous modifications and variations of the described examples and embodiments are possible in light of the above teachings of the disclosure. The disclosed examples and embodiments are presented for purposes of illustration only. Other alternate embodiments may include some or all of the features disclosed herein. Therefore, it is the intent to cover all such modifications and alternate embodiments as may come within the true scope of this invention, which is to be given the full breadth thereof. Additionally, the disclosure of a range of values is a disclosure of every numerical value within that range.

We claim:

1. A lid assembly comprising:

a cover member for attachment to a container, the cover member including first and second apertures providing access to contents of the container;

a drinking member having a bore therethrough, the drinking member pivotal between a first closed position wherein the drinking member seals the first aperture and a second open position wherein the bore is aligned with the first aperture to allow contents of the container to pass through the first aperture and the drinking member; and a closure member pivotal between a first closed position wherein the closure member seals the second aperture and a second open position wherein the second aperture is exposed to allow contents of the container to pass therethrough, wherein the drinking member and the closure member have the same axis of rotation.

2. The lid assembly of claim 1, wherein the cover member is removably attached to the container via screw fit, snap fit or friction fit.

3. The lid assembly of claim 1, wherein the closure member includes a protrusion extending from one side thereof, the protrusion shaped to engage the second aperture with the closure member in the first closed position.

4. The lid assembly of claim 1, wherein the cover member includes a straw member extending therefrom and in fluid communication with the first aperture, the straw member extending into the container with the cover member attached to the container.

5. The lid assembly of claim 1, wherein the cover member, drinking member and closure member are made of plastic.

6. The lid assembly of claim 1, wherein the first closed position and the second open position of the drinking member are approximately 90-degrees apart.

7. The lid assembly of claim 1, wherein with the drinking member and the closure member each in the first closed position, the first and second apertures are sealed and the drinking member and the closure member lie adjacent one another.

8. The lid assembly of claim 1, wherein the cover member includes a vent aperture, wherein with the closure member in the first closed position the closure member seals the vent aperture, and with the closure member in the second open position the vent aperture is exposed to allow air to be vented from the container.

9. The lid assembly of claim 8, wherein the closure member includes a vent protrusion extending from the one side thereof, the vent protrusion shaped to engage the vent aperture with the closure member in the first closed position.

10. The lid assembly of claim 1, wherein the drinking member is pivotal to a third closed position wherein the drinking member seals the first aperture.

11. The lid assembly of claim 10, wherein with the drinking member in the third closed position the closure member is pivotal from the first closed position to the second open position.

12. The lid assembly of claim 10, wherein the third closed position and the first closed position of the drinking member are greater than 90-degrees apart.

13. The lid assembly of claim 10, wherein with the drinking member in the third closed position and the closure member in the second open position, the drinking member and the closure member lie adjacent one another.

14. The lid assembly of claim 10, wherein the closure member is only pivotal from the first closed position to the second open position with the drinking member in the third closed position.

15. The lid assembly of claim 10, wherein the drinking member is only pivotal to the third closed position by pivoting the closure member from the first closed position.

16. The lid assembly of claim 15, wherein the drinking member has at least one pin that engages at least one stop surface on the closure member as the drinking member is moved from the second open position to the third closed position to move the closure member from the first closed position.

17. The lid assembly of claim 1, wherein the first closed position and the second open position of the closure member are greater than 90-degrees apart.

18. The lid assembly of claim 1, wherein the drinking member and the pivoting closure member are disposed in a channel formed in a top surface of the cover member.

19. A lid assembly comprising:

a cover member for attachment to a container, the cover member including first and second apertures providing access to contents of the container;

a drinking member having a bore therethrough, the drinking member pivotal between a first closed position wherein the drinking member seals the first aperture and a second open position wherein the bore is aligned with the first aperture to allow contents of the container to pass through the first aperture and the drinking member; and a closure member pivotal between a first closed position wherein the closure member seals the second aperture and a second open position wherein the second aperture is exposed to allow contents of the container to pass therethrough, wherein with the drinking member and the closure member each in the first closed position, the first and second apertures are sealed and the drinking member and the closure member lie adjacent one another.

20. The lid assembly of claim 19, wherein the drinking member is pivotal to a third closed position wherein the drinking member seals the first aperture.

* * * * *

UNITED STATES PATENT AND TRADEMARK OFFICE

CERTIFICATE OF CORRECTION

PATENT NO. : 8,672,174 B1
APPLICATION NO. : 13/739409
DATED : March 18, 2014
INVENTOR(S) : Morgan Requel McMullin It is certified that error appears in the above-identified patent and that said Letters Patent is hereby corrected as shown below:

On the Title Page

At Item (57) Abstract, line 4; please change “there through” to read “therethrough”.

At Item (57) Abstract, lines 12-13; please change “there through” to read “therethrough”.

In the Specification

At Col. 2, line 7; please change “there through” to read “therethrough”.

At Col. 6, line 33; after “any”, please insert the word -- of --.

Signed and Sealed this
Twenty-fourth Day of June, 2014

Michelle K. Lee

Michelle K. Lee
*Deputy Director of the United States Patent and Trademark Office*